United States Patent [19]

Sée et al.

[11] 4,437,281

[45] Mar. 20, 1984

[54] WALL CONSTRUCTION PREFABRICATED FROM SELF-CONNECTABLE ELEMENTS

[75] Inventors: Jacques L. A. Sée, Neuilly-sur-Seine; Sylvain V. L. Chevanne, Themericourt, both of France

[73] Assignee: Honeycomb Panels Patents Association Inc., Malibu, Calif.

[21] Appl. No.: 345,136

[22] Filed: Feb. 2, 1982

[30] Foreign Application Priority Data

Feb. 3, 1981 [FR] France ..... 81 02036

[51] Int. Cl.[3] ..... E04C 1/00

[52] U.S. Cl. ..... 52/309.1; 52/508; 52/764

[58] Field of Search ..... 52/292, 309.1, 309.4, 52/309.11, 418, 419, 424, 428, 479, 508, 764, 770, 772

[56] References Cited

U.S. PATENT DOCUMENTS

| | | | |
|---|---|---|---|
| 963,889 | 7/1910 | Goodwin | 52/424 X |
| 2,787,809 | 4/1957 | Stastny | 52/309.4 X |
| 3,504,470 | 4/1970 | Pincemin | 52/508 X |
| 3,605,365 | 9/1971 | Hastings | 52/309.11 |
| 3,841,958 | 10/1974 | DeLorme | 52/309.11 |
| 4,189,125 | 2/1980 | Little | 52/292 X |

*Primary Examiner*—J. Karl Bell

*Attorney, Agent, or Firm*—Browdy and Neimark

[57] ABSTRACT

The wall construction is prefabricated from self-connectable elements divided each into four compartments by cross-pieces and each comprising a first hollow elements with a square frame forming also cross-pieces and diagonal ribs. The first hollow element has on one side protruding fingers for cooperating with a facing plate formed with holes corresponding to the protruding fingers, the diagonal ribs protruding on other side of the frame and being each formed with at least one notch complementary to that of the similar diagonal ribs carried by a second element made in the same manner as the first element but closed on its side opposite to that form which protrude the diagonal ribs so that said second element forms a facing surface.

9 Claims, 8 Drawing Figures

WALL CONSTRUCTION PREFABRICATED FROM SELF-CONNECTABLE ELEMENTS

FIELD OF THE INVENTION

The present invention is directed to a new construction made from elements connectable together for forming alveolated and wind-braced double wall hollow pannels, the assembly of complementary elements which the construction according to the invention comprises being carried out by a nesting operation wherein two elements are doubly off-set and staggered. The construction according to the invention provides a particularly light and resistent arrangement which moreover, is adapted both to life conditions prevailing inside a building and to bad weather conditions possibly prevailing outside a building, while making an adaptation possible without changing the basic elements forming the construction.

OBJECT AND SUMMARY OF THE INVENTION

Starting from the same basic elements forming the inner walls and the support structure of the building, it is thus possible to make an assembly adapted to extreme hot conditions, or on the contrary to very cold conditions.

According to the invention, the wall construction which is prefabricated from self-connectable elements each divided into four compartments by cross-pieces and each comprising ribs forming diagonals, is characterized by first and second hollow elements, the first hollow element comprising a square frame forming also cross-pieces and diagonal ribs, said hollow element having on one side protruding fingers for cooperating with a facing plate having holes corresponding to the protruding fingers, the diagonal ribs protruding on other side of the frame and being each formed with at least one notch complementary to that of the similar diagonal ribs which the second element comprises, the second element being of a construction similar to that of the first element, but closed on its side opposite to that from which protrude the diagonal ribs so that the second element forms a facing surface.

Various other features of the invention will appear from the following description.

BRIEF DESCRIPTION OF THE DRAWINGS

An embodiment of the object of the invention is shown, by way of a non limiting example, in the accompanying drawings wherein.

DETAILED DESCRIPTION OF THE PREFERRED EMBODIMENT

Figure 1:
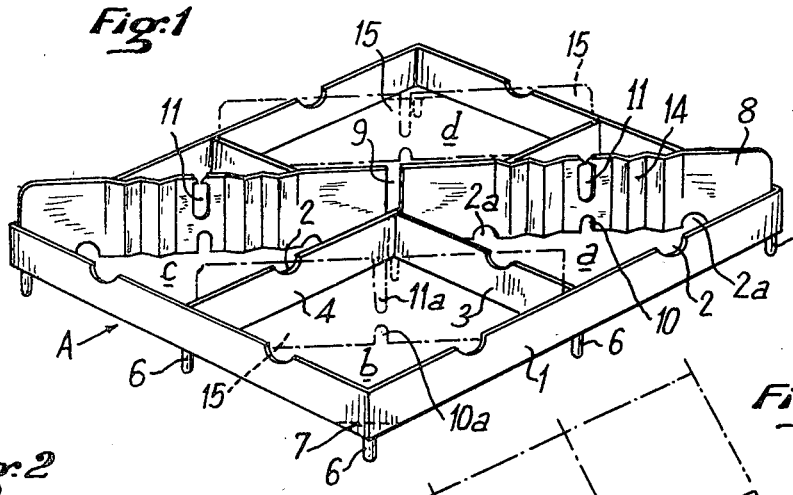
FIG. 1 is a perspective view of the main element or core constituent of the walls.

The element shown in FIG. 1 is designated as a whole by the reference letter "A". This element comprises a frame 1 of a square shape, one of its edges being formed with notches 2. The frame 1 contains insidely two cross-pieces 3, 4 defining four compartments a, b, c, and d. The cross-pieces 3, 4 are also formed with notches 2 in one of their edges.

Fingers or pins 6 are formed so as to protrude from the frame 1 on its side opposite to that comprising the notches 2. The fingers 6 are slightly retrated relative to the frame and are, for example, supported by the cross-pieces and by gussets formed at the angles of the frame.

Each element A comprises a main diagonal rib 8 formed, at intersection of the cross-pieces 3, 4, with a notch 9 the width of which is substantially equal to four times the wall thickness of the frame 1. The diagonal rib 8 has a height which is almost double to that of the frame 1 and cross-pieces 3, 4.

For reasons explained hereinbelow, the rib 8 is formed, in register with the center of each compartment a and c, with a lower notch 10 and an upper notch 11 at the upper end of which are formed two burrs 12, 13 diverging from each other while extending substantially up to middle of the notch 11.

In addition, it is advantageous that some of the portions of the main diagonal rib 8 is formed with waves 14 as well as with notches 2*a* similar to those of the frame 1 and cross-pieces 3, 4.

The element A includes also secondary diagonal ribs 15 shown in chain-dot lines for more clarity in the drawing, these diagonal ribs being formed, in their median portion, with notches 10*a*, 11*a* similar to notches 10, 11 of the main rib 8.

The whole element A is provided by being molded from a synthetic material, and preferably a thermoplastics material.

Figure 2:
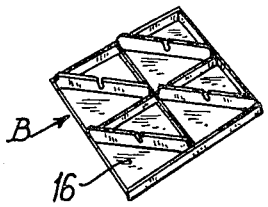
FIG. 2 is a perspective view similar to FIG. 1, but at a smaller scale, of a facing element.

A second element is element B shown at a smaller scale in FIG. 2, the second element B being made exactly as described hereabove with reference to element A but comprising further a bottom 16 which forms a facing surface. The element B can be fabricated as the element A from a synthetic resin, but it can also be fabricated in fibrocement or other moldable material having, as far as possible, a low thermal transmission coefficient.

When the element B is made of a synthetic resin, its bottom 16 can be advantageously made of plaster, reinforced or not with fibers, or of various composite materials having good thermal and accoustic characteristics.

The elements B are also of a square shape, but elements B' are also advantageously provided, having a rectangular shape, the larger side of which is equal to the side of elements A, while their smaller side is equal to half the side of this element. In such a case, the elements B' have only two secondary ribs parallel to each other, as are the secondary ribs and the main ribs of elements B and A. Elements A' are also provided and correspond to elements A while having the dimensions of the elements B'.

Figure 3:
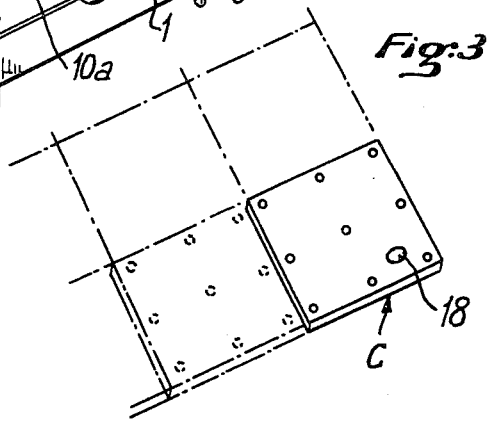
FIG. 3 is a perspective view of a facing plate.
Figure 4:
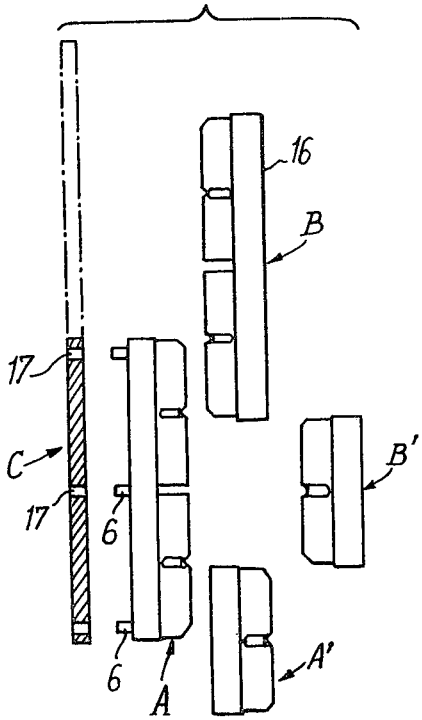
FIG. 4 is a side elevation view showing the respective positions of the elements having to be assembled together for forming a wall.
Figure 7:
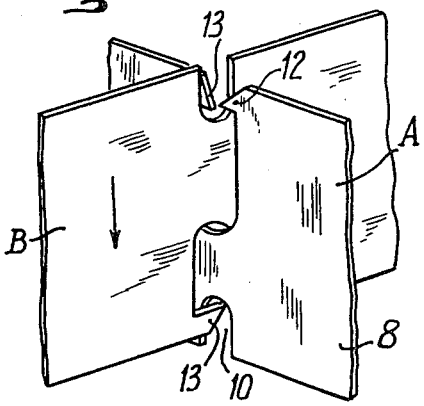
FIG. 7 is a perspective view similar to FIG. 6, illustrating a self-locking engagement made upon an assembling of the elements together.

The construction according to the invention comprises also—as main elements—facing plates C shown in FIG. 3 and FIG. 4. The facing plates C can be made of various homogeneous or composite materials and, for example, fibrocement, plastics materials, reinforced or not by a glass-resin sandwich incorporating also possibly one or several reflecting leaves, for example, in aluminium.

Although not shown, it is advantageous that the inner face of the facing plate is rough or formed with loops or hooking protrusions in register with compartments a, b, c of the element A.

The facing plate C is formed with holes 17, the positions of which correspond to those of the fingers 6 of the element A. As shown in the drawing, the size of facing plate C can indifferently correspond to that of an element A or to that of a multiple of element A.

Figure 5:
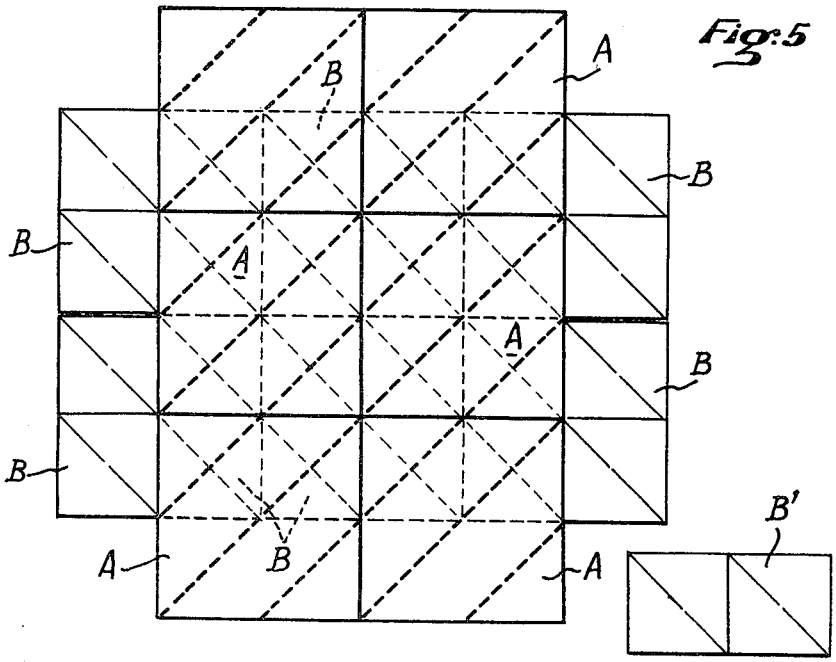
FIG. 5 is a front view showing the assembly of several elements together, the cross-pieces of the elements not being shown for sake of clarity.
Figure 6:
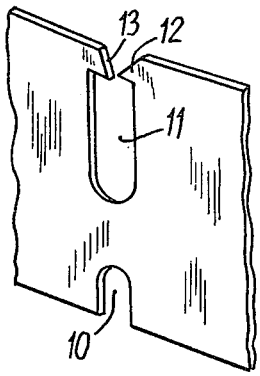
FIG. 6 is a greatly enlarged perspective view of a detail shown in FIG. 1.

For erecting a wall, elements A are positioned, as shown in FIGS. 4 and 5, side by side and two contiguous lower elements A are connected by means of an element B. When engaging elements B, the burrs 12, 13 of their main rib which is perpendicular to the main rib of the element A are caused to pass between the burrs 12, 13 of the main rib of said element, then on the solid portion of the main rib 8 of said element. Finally they are engaged into notch 10 of the main rib 8 of the element A. This mutual engagement of the burrs 12, 13 of the two elements is made possible due to the flexibility of the burrs, at least of those of the element A which is made of a synthetic resin.

What has just been described is carried out in the same manner as regards the secondary diagonal ribs, and it appears consequently that the engagement of elements B in an element A is followed by a locking of these elements together.

FIG. 5 shows that elements A are thus positioned one after the other and connected by elements B. FIG. 5 shows that each time an element A is connected to four elements B, the same being true for the elements B. When the wall is almost completed, side strips remain which are not provided with elements B, but there is then used elements B' which are connected by one of their halves to elements A, and elements A' (FIG. 4) connected in the same way to the protruding portions of the elements B.

After assembling the elements A, B, A' and B', the plates C are set in position by being threaded onto the fingers 6, and the fingers 6 are finally riveted, for example by using a hot flat iron.

The walls set up as described hereabove can be considered as completed. But according to an advantageous development of the invention, there is provided holes 18 (FIG. 3) either in the facing plates C or in the bottoms 16 of the elements B, or both in the facing plates C and the bottoms 16 of the elements B, the holes 18 being provided for injection of a resin foam which can travel inside the wall as assembled, by passing through the notches **2, 2*a*** formed to this effect. The foam has as an object to provide a final fixation of the assembled elements, and to improve thermal and acoustic insulation, and also, if chosen amongst closed-cell resin foams, to complete the tightness so that it becomes possible to realize roof panels with the means as described.

Figure 8:
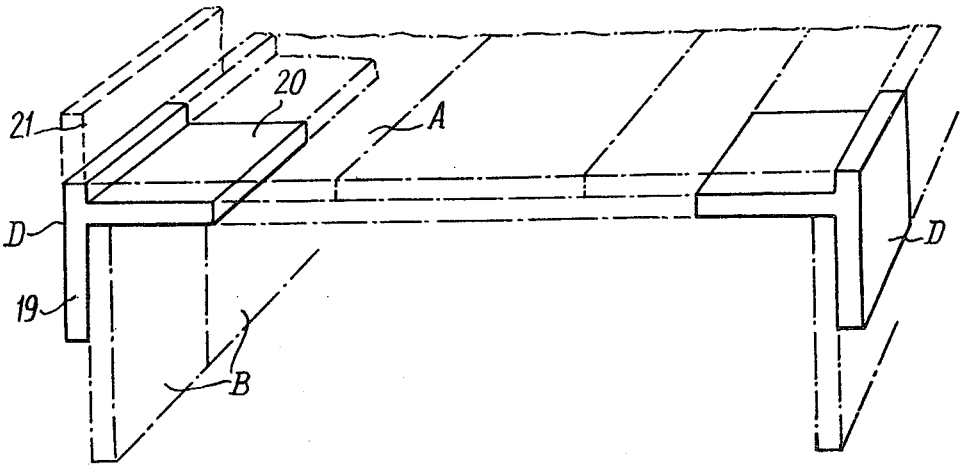
FIG. 8 is a diagrammatic perspective view illustrating angle elements for the connection of walls extending in different planes.

When elements should be assembled for defining two walls forming an angle, there is used angle pieces D shown in FIG. 8, one side 19 of which being of a construction similar to that of an element A, while the other side 20 has a construction similar to that of an element B. The side 19 protrudes beyond the side 20 over a distance corresponding at least to the thickness of an element B.

Through this means, the side 19 of the angle elements can be assembled to elements B, while sides 20 can be assembled to elements A. The operation goes on from element to element and in the same manner as described previously. If elements D are used for connecting vertical walls to a wall forming a roof, then the elements D can be provided so that a protruding portion 21 forms a raising edge providing for the subsequent laying of sheets, plates or sealing products of some sort.

The invention is not limited to the embodiments shown and described in detail and various modifications can be carried out without departing from its scope.

We claim:

1. A wall construction prefabricated from self-connectable elements divided each into four compartments by cross-pieces and each comprising ribs forming diagonals, characterized by first and second hollow elements, the first hollow element comprising a square frame forming also cross-pieces and diagonal ribs, said hollow element having on one side protruding fingers for cooperating with a facing plate formed with holes corresponding to the protruding fingers, the diagonal ribs protruding on other side of the frame and being each formed with a least one notch complementary to that of the similar diagonal ribs carried by the second element, the second element being made in the same manner as the first element but closed on its side opposite to that from which protrude the diagonal ribs so that said second element forms a facing surface.

2. A construction according to claim 1, wherein the fingers of the first element are riveted on the plates which are threaded onto them.

3. A construction according to either claim 1 or 2, wherein the first elements are provided by molding from a thermo-plastic resin, the second elements and the facing plates being made of a material taken among a same material and different materials.

4. A construction according to claim 1, wherein the facing surfaces of the second elements are made of a material of plaster or agglomerated material.

5. A construction according to claim 1, wherein the facing plates are made of a material of fibrocement, homogeneous or composite plastics materials.

6. A construction according to claim 1, wherein the facing plates include insulating materials.

7. A construction according to claim 1, wherein the ribs protruding from the first and second elements define burrs off-set at one end from a first notch which they present as well as a second notch in alignment with the first notch for providing a locking of the burrs when engaging one group of first elements with a group of second elements.

8. A construction according to claim 1, wherein notches are provided in the frame, the cross-pieces and the diagonal ribs of the first and second elements, for passage of a resin foam developed inside the elements after assembling of the elements.

9. A construction according to claim 1, wherein angle elements are provided, a first portion of said angle elements having a configuration similar to that of the first elements, a second portion of said angle elements, at right angle to the first portion, having a configuration similar to that of the second elements, said first portion defining with the second portion a protruding edge the thickness of which corresponds at least to that of the first elements.

* * * * *